US007156377B2

(12) United States Patent
Chapman et al.

(10) Patent No.: US 7,156,377 B2
(45) Date of Patent: Jan. 2, 2007

(54) WATER AERATION DEVICE AND METHOD

(76) Inventors: Teddie C. Chapman, 4912 E. 97th Ave., Tampa, FL (US) 33617; James C. Terry, III, 27810 Sandbagger La., Wesley Chapel, FL (US) 33544

( * ) Notice: Subject to any disclaimer, the term of this patent is extended or adjusted under 35 U.S.C. 154(b) by 0 days.

(21) Appl. No.: 11/223,770

(22) Filed: Sep. 9, 2005

(65) Prior Publication Data

US 2006/0027938 A1 Feb. 9, 2006

Related U.S. Application Data

(63) Continuation-in-part of application No. 10/427,545, filed on May 1, 2003, now Pat. No. 6,986,506.

(60) Provisional application No. 60/622,578, filed on Oct. 27, 2004.

(51) Int. Cl.
*B01F 3/04* (2006.01)

(52) U.S. Cl. ..... 261/76; 96/204; 261/116; 261/DIG. 75

(58) Field of Classification Search ..... 261/76, 261/116, 118, DIG. 75, 123; 95/185, 260; 96/204

See application file for complete search history.

(56) References Cited

U.S. PATENT DOCUMENTS

| | | | | |
|---|---|---|---|---|
| 1,491,057 | A | 4/1924 | Myers | 417/174 |
| 3,282,227 | A | 11/1966 | Nielsen | 417/167 |
| 4,041,981 | A | 8/1977 | Davis et al. | 261/64.1 |
| 4,210,534 | A | 7/1980 | Molvar | 261/76 X |
| 4,308,138 | A | 12/1981 | Woltman | 261/DIG. 75 |
| 4,313,827 | A | 2/1982 | Ratigan et al. | 210/136 |
| 4,333,833 | A | 6/1982 | Longley et al. | 210/198.1 |
| 4,710,325 | A | 12/1987 | Cramer et al. | 261/24 |
| 4,936,552 | A | 6/1990 | Rothrock | 261/76 |
| 4,956,080 | A | 9/1990 | Josefik | 210/109 |
| 5,098,614 | A | 3/1992 | Yeh et al. | 261/64.1 |
| 5,298,198 | A | 3/1994 | LaCrosse | 261/76 |
| 5,403,522 | A | 4/1995 | Von Berg | 261/36.1 |
| 5,525,242 | A | 6/1996 | Kerecz | 210/758 |
| 6,042,089 | A | 3/2000 | Klein | 261/76 |
| 6,162,021 | A | 12/2000 | Sarshar et al. | 417/174 |
| 6,398,194 | B1 | 6/2002 | Tsai et al. | 261/36.1 |
| 6,682,057 | B1 | 1/2004 | La Crosse | 261/76 |
| 6,986,506 | B1 * | 1/2006 | Chapman et al. | 261/76 |
| 2004/0113288 | A1 * | 6/2004 | Korzeniowski | 261/76 |

FOREIGN PATENT DOCUMENTS

| | | | | |
|---|---|---|---|---|
| JP | 52-46571 | * | 4/1977 | 261/DIG. 75 |

* cited by examiner

*Primary Examiner*—Richard L. Chiesa
(74) *Attorney, Agent, or Firm*—Allen, Dyer, Doppelt, Milbrath & Gilchrist, P.A.

(57) ABSTRACT

A liquid feed line includes a stepped internal nozzle and an exit diameter smaller than the diameter of the liquid feed line. The stepped internal nozzle desirably introduces hydrodynamics or hydraulic waves for the fluid, with the number of steps selected based on the pressure of the motive flow. By limiting the length of the stepped internal nozzle cylinder, a desirable splayed liquid stream is formed within a mixing chamber in fluid communication with a vent line. An exit cylinder in fluid communication with the mixing chamber includes a channel through which an aerated liquid stream of fluid passes. The entrance and exit faces forming the channel are substantially perpendicular to the fluid flow with the channel having a generally uniform dimension, neither converging nor diverging, and a diameter 1 to 10 times greater, depending on the pressure of the motive flow, than the exit to the internal nozzle.

20 Claims, 3 Drawing Sheets

WATER AERATION DEVICE AND METHOD

CROSS-REFERENCE TO RELATED APPLICATIONS

This application is a Continuation in Part of U.S. application Ser. No. 10/427,545, filed May 1, 2003 and issuing as U.S. Pat. No. 6,986,506, and claims the benefit of U.S. Provisional Application No. 60/622,578, filed Oct. 27, 2004, the disclosures of which are hereby incorporated by reference herein in their entireties, and all commonly owned.

FIELD OF THE INVENTION

The invention generally relates to devices and methods for introducing a gas into a liquid or degassing of a liquid, and more particularly to aeration of water.

BACKGROUND OF THE INVENTION

Bodies of water, such as lakes, ponds, canals, pools, and the like suffer from the growth of algae and other undesirable aquatic biota that lead to the depletion of oxygen and other elements required to sustain life therein. In nature, air is generally absorbed in a body of water through the agitation of surface waters resulting from waves and wind. Smaller bodies of water in stagnant areas often do not have this resource and as a result, the life forms living in such bodies of water often succumb to the absence of oxygen or relocate to other more oxygenated areas.

Apparatus for introducing a gas into a liquid is known in the art. Numerous inventors have proposed solutions to these problems. Many of these solutions utilize bubbling aeration pumps or require the use of a plurality of liquid pumps to aerate the water. As discussed more fully below, such systems are inefficient and subject to malfunction For example, U.S. Pat. No. 4,210,534 to Molvar discloses a system of mixing a gas with wastewater wherein the gas is injected, under pressure, into the water in a mixing chamber, where it is then discharged. This system requires a pump for the wastewater and an additional pump for pressurizing the air for injection. In addition, the air/wastewater mixture is exited through a tapered exit cylinder wherein the velocity of the mixture is increased.

U.S. Pat. No. 4,308,138 to Woltman describes a method wherein the water passes through a venturi thereby increasing water velocity and further passing through a barrel that acts as an exit chamber. Air is pulled under vacuum introduced into the water stream. The stream of water passes through the barrel; however, it does not come into contact with the sides of the barrel. The barrel then gradually opens where the air is further mixed with the water before it exits the system. This system does not create sufficient suction to saturate the water with air due to the tapered nature of the entrance to the exit cylinder. A further drawback occurs in that cavitation does not occur in the exit cylinder. This is because the water/air mixture passing through the barrel does not substantially come into contact with the walls of the exit cylinder.

U.S. Pat. No. 4,936,552 to Rothrock utilizes flowing water upstream of a reducing means to create a vacuum thereby pulling ambient air from the atmosphere and introducing it into the flowing wastewater stream. While this system is capable of partial aeration, it cannot attain oxygen levels sufficient to provide the desired results in a lake, pond, canal, pool or the like.

U.S. Pat. No. 6,398,194 to Tsai et al. discloses a water-pressure type aeration device utilizing a powerful water pump, which moves water through a distribution head to a plurality of cavitation housings. The plurality of cavitation housings is further in fluid communication with surface air. Where water passes into the cavitation housings, it decreases the pressure therein and pulls a vacuum that, in turn, pulls air from the surface. The air is mixed with water wherein it is then expelled from the apparatus through a downward inclined guide element. All of the aforementioned aeration systems suffer from certain shortcomings, some more serious than others. For example, some require the use of more than one pump or moreover, require the use of more than one type of a pump. Any of the deficiencies suffered by these devices can result in losses in efficiency and ultimately result in economic losses. Accordingly, the following disclosure describes improvements in the art of water aeration.

All documents and publications cited herein are incorporated by reference in their entirety, to the extent not inconsistent with the explicit teachings set forth herein.

BRIEF SUMMARY OF THE INVENTION

An apparatus and method for the introduction of a gas into a liquid, and/or to degas a liquid, which includes a liquid supply, a liquid feed tube, a stepped reducing means, a vent line, a mixing chamber, and an exit cylinder of uniform dimensions, said dimensions neither converging nor diverging in the exit cylinder.

An apparatus is provided for degassing of water of hydrogen sulfide, ammonia or other such gases that are detrimental to aquatic life.

For example, take a 7 year old concrete Koi pond of approximately 5000 gal., which was loaded with algae, with a clarity depth of 2 inches, with a bio filter system, chemical support for water clarity and algae control, water fall and head sprays for aeration and UV lights for sanitation. After installing our nozzle with the pump running continuously, we were able to clean up the water to crystal clear in 5 days without the use of chemicals, by degassing the water of ammonia, which deprived the algae of nutrients, killing the algae. The fish were not removed for this test. The Koi were later observed to be spawning for the first time since the ponds initial start up 7 years before.

An apparatus that is linear in its delivery of oxygen as tested by GSEE Environmental Engineering.

An apparatus that does not make use of a venturi in its design.

An apparatus that only has to flow half the volume of containment for the water to reach saturation, as tested by GSEE Environmental Engineering.

For example, a Mazzie nozzle #1583, which has a ⅜ inch motive flow and used with a 2 hp. pump generating 40 psi. through the nozzle, had to flow the containment 1.5 times before reaching saturation. Our nozzle, which is the object of this patent application, with a ⅜ inch motive flow and used with the same 2 hp. pump generating 40 psi through our nozzle, reached saturation after flowing half the containment volume, which is 3 times faster than a mazzie #1583.

Liquid is supplied under pressure from the liquid supply through the liquid feed tube. As liquid passes through the liquid feed line, it is passed through a stepped reducing means where the velocity is increased. The steps are substantially at right angles to the internal motive flow to induce hydrodynamics or hydraulic waves, the dynamics or waves of which are maximized for liquid splay by limiting the internal nozzle cylinder length, dependent on the pressure of the motive flow. The exit of the reducing means results in a high speed stream of splayed water that is then focused, by way of the focal length of the splayed water, into the exit cylinder, the diameter of the exit cylinder is 1 to 10 times larger than the diameter of the intemal nozzle cylinder exit, dependent on the pressure of the motive flow. The splayed water passes through the mixing chamber and enters the exit cylinder. The entry of the splayed water into the exit cylinder reduces the internal pressure of the mixing chamber, thereby creating a suction, by acting as a continuous flow piston, first as in the down stroke/intake stroke at the entrance to the exit cylinder, then transitioning to a compression stroke before reaching the exit of the exit cylinder, which creates a continuous draw on the vent line. The suction created results in a vacuum effect, as much as 29 inches of mercury, on the vent line whereby a gas is pulled through the vent tube (generally in communication with ambient air from the surface) and introduced to the splayed water in the mixing chamber. The splayed water /gas combination is passed through the exit cylinder where the water stream is subjected to cavitation as the splayed water/air mixture passes along the walls of the exit cylinder. As the system cavitates, the gas is mixed with the liquid to the point where the liquid becomes saturated with the gas. The liquid gas mixture is then subjected to compression as the liquid/gas mixture nears the exit of the exit cylinder where the remaining gas is released in the form of bubbles.

Accordingly, it is an object of the present invention to provide an improved apparatus for the introduction of gas into a liquid.

It is a further object of the present invention to provide an apparatus and method for the aeration of water.

It is a still further object of the present invention to provide an improved water aeration apparatus for lakes, ponds, canals, pools and the like.

It is a still further object of the present invention to provide an apparatus and method for the degassing of water.

It is a still further object of the present invention to provide an apparatus and method for aeration that does not incorporate a venturi in the design.

It is a still further object of the present invention to provide an apparatus and method capable of producing an air/water ratio of up to 10 to 1.

Further objects and advantages of the present invention will become apparent by reference to the following detailed disclosure of the invention and appended drawings wherein like reference numbers refer to the same element, component, or feature.

BRIEF DESCRIPTION OF THE DRAWINGS

For a fuller understanding of the invention, reference is made to the following detailed description, taken in connection with the accompanying drawings illustrating various embodiments of the present invention, in which.

DETAILED DESCRIPTION OF EMBODIMENTS OF THE INVENTION

Figure 1:
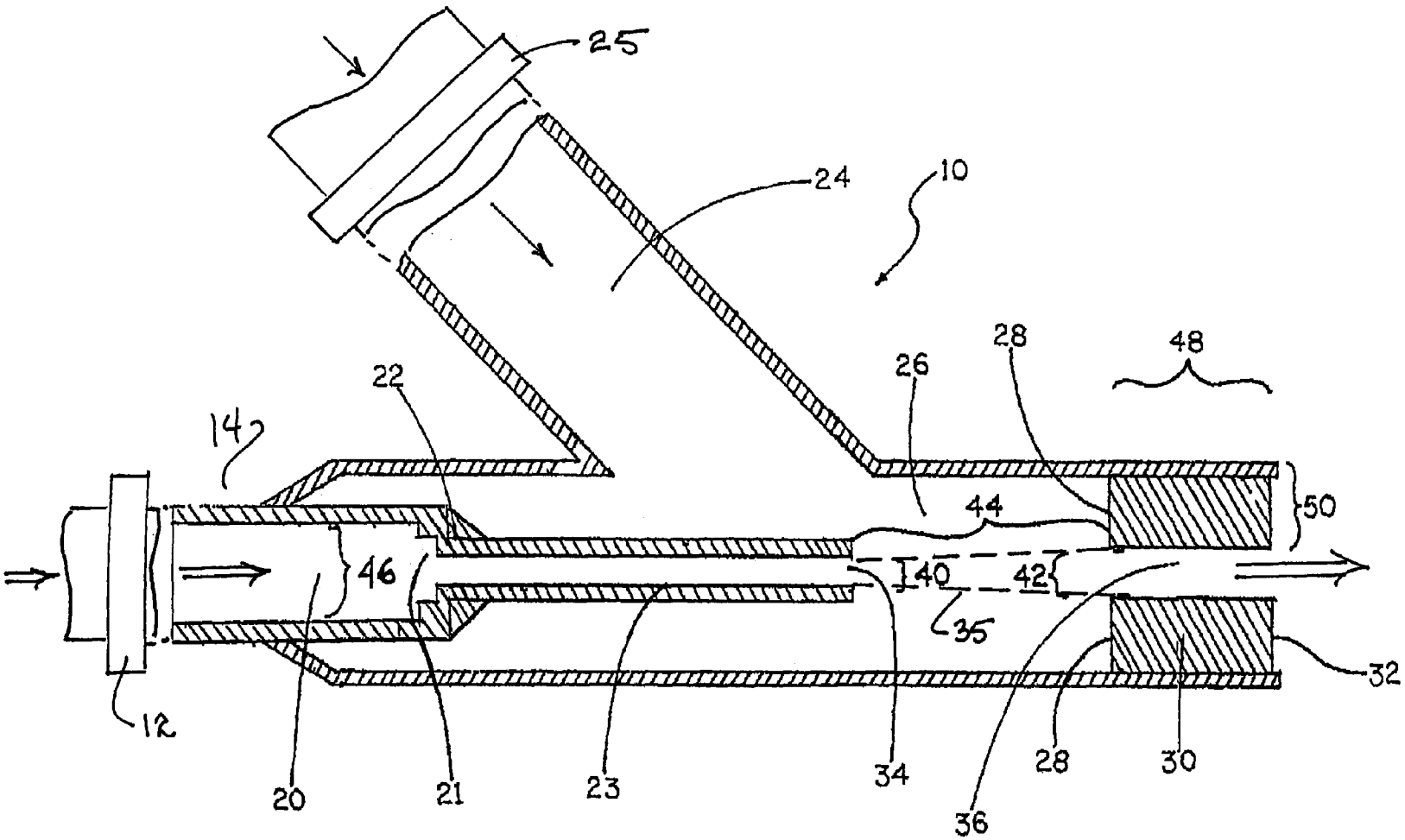
FIG. 1 is a full, sectional view of the apparatus in accordance with the present invention.
Figure 2:
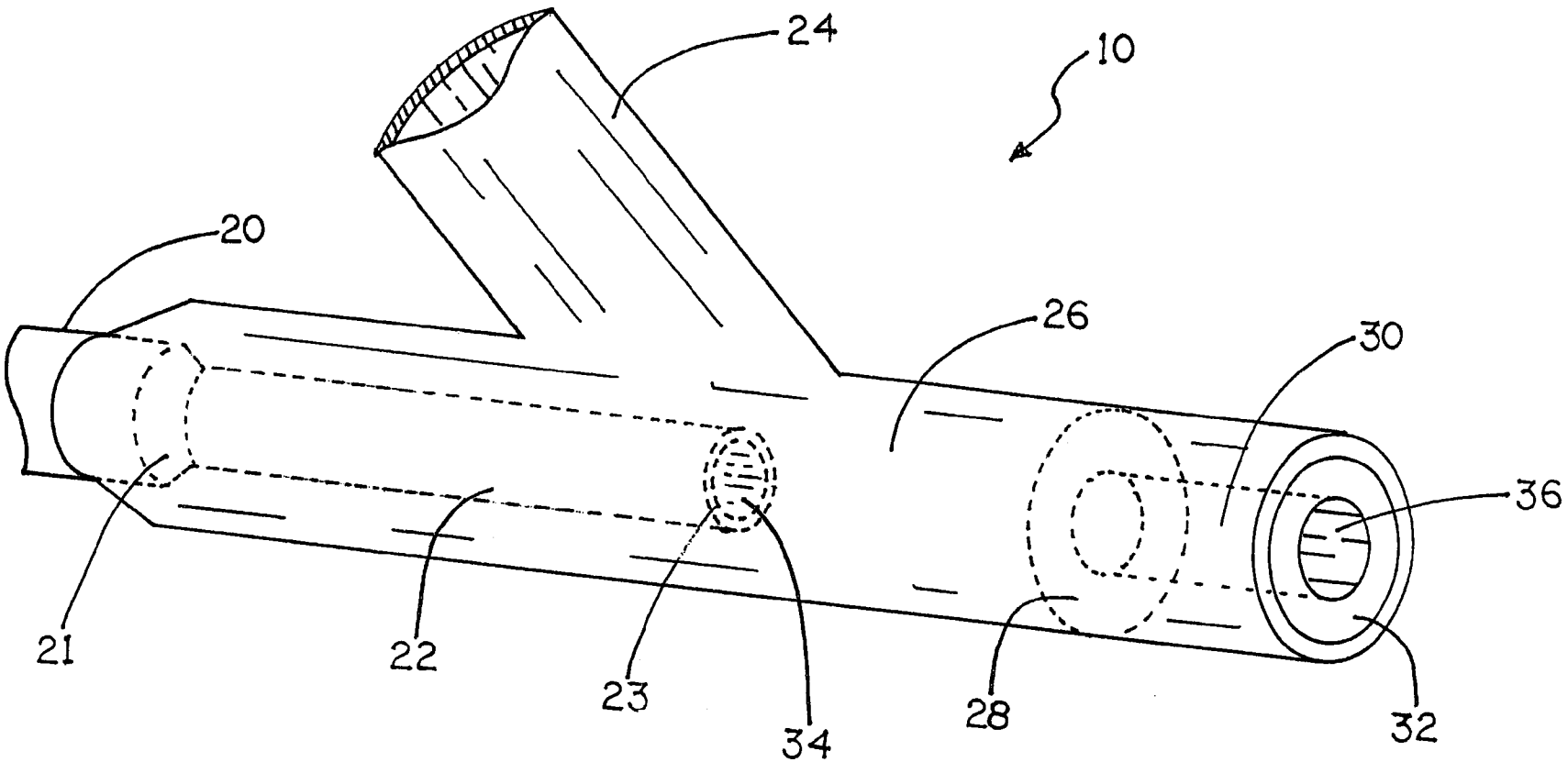
FIG. 2 is a fragmentary perspective view of the apparatus in accordance with the present invention.
Figure 3:
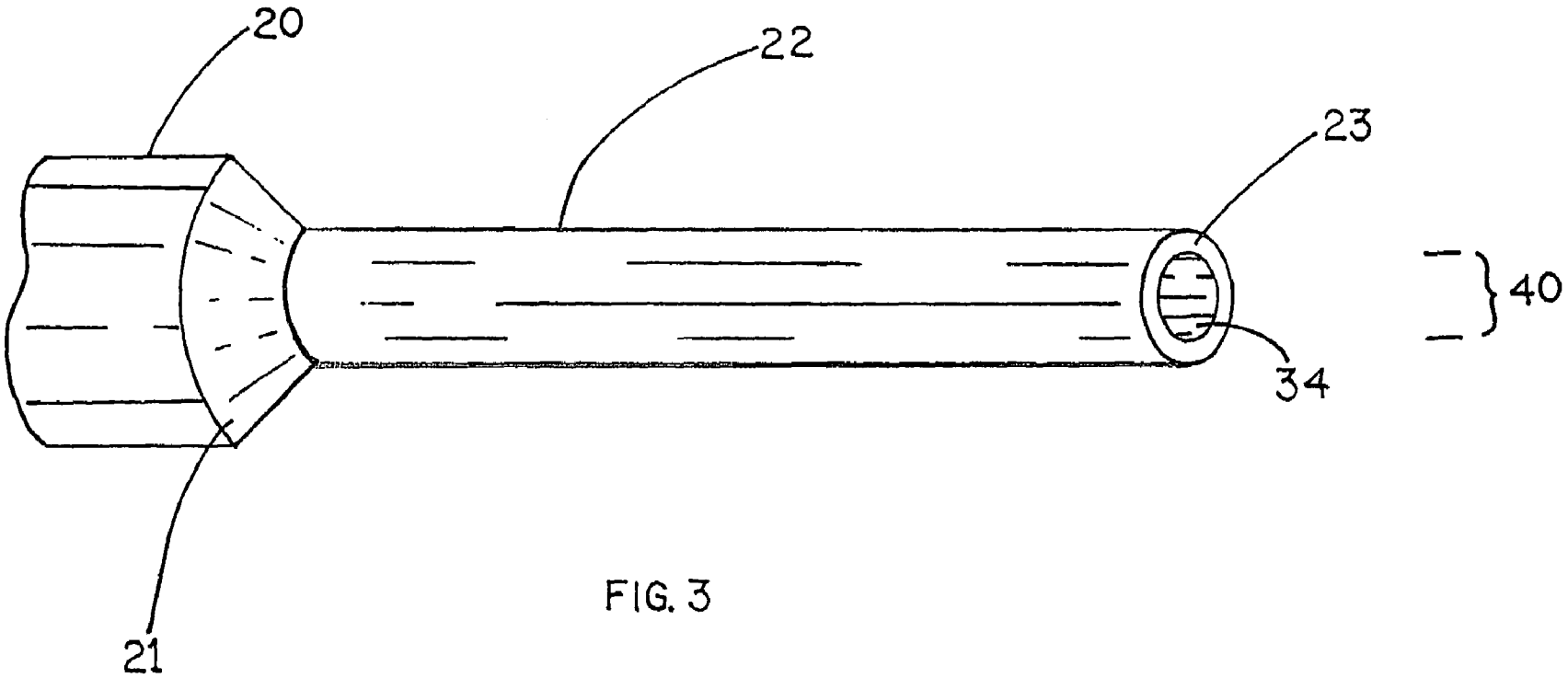
FIG. 3 is a perspective view of the internal nozzle in accordance with the present invention.

Referring now to FIG. 1, an apparatus for the improved aeration of water is illustrated and generally designated by the reference numeral 10.

The apparatus 10 can be utilized either above or below the surface of the liquid into which a gas is to be introduced. Typically, the apparatus is submerged to a depth at which a gas can be pulled under vacuum through the apparatus. A liquid supply 12, generally a pump or a pressurized storage tank, supplies liquid under pressure through a liquid feed line 20. As will come to the mind of those skilled in the art, the liquid supply 12 may include well known pump styles such as bellows, centrifugal, diaphragm, drum, flexible liner, flexible impeller, gear hand, impeller, immersible, peristaltic piston, progressing cavity, and rotary immersible, by way of example. The liquid feed line enters into a first end of the apparatus 10 and is connected to a stepped internal nozzle 22 concentrically disposed in the mixing chamber 26 of the apparatus 10.

The stepped internal nozzle 22 generally comprises a stepped reducing means 21 in fluid communication with the feed line 20 at a first end 14 and a cylinder 23 at a second end. The stepped internal nozzle 22 is generally concentrically disposed and terminates in the mixing chamber 26. It is not necessary, however, that the stepped internal nozzle 22 be concentrically disposed in the mixing chamber 26 as it may be disposed in any position in the mixing chamber 26, so long as the liquid stream flowing from the internal nozzle 22 enters the exit channel 36 unobstructed. The stepped reduction of the liquid feed line 20 to a point where the internal nozzle exit 34 has a diameter 40 smaller than the diameter 46 of the liquid feed line 20 will suffice, said number of steps dependent on the pressure of the motive flow (for example, a series of commercially available stepped reducing adapters). The length of cylinder 23 is determined by the maximum splay of the motive flow, the hydro dynamics or hydraulic waves of which are set up by the stepped reduction of the internal nozzle. The longer the length of the cylinder 23, the more the hydro dynamics or hydraulic waves stabilize, smooth out and loose their splay. The hydro dynamics or hydraulic waves are affected by the pressure of the motive flow at the entrance of the stepped reduction, as well as the number of steps in the reduction and also by the diameter of cylinder 23, of which the maximum splayed motive flow ultimately determines the length of cylinder 23. The length is generally 1 to 10 times the diameter of cylinder 23, dependent on the pressure of the motive flow, with the walls of cylinder 23 of uniform dimensions, neither converging nor diverging along its length.

A vent line 24 is connected to and in fluid communication with the mixing chamber 26 at a point more medial of the apparatus 10. The vent line 24 is in fluid communication with the mixing chamber 26 at a first end and a gas supply, generally ambient air at a second end. It is not necessary that the vent line be in communication with ambient air as one or more gas supplies may also be connected to the vent line 24 so that a gas other than air can be introduced into the liquid.

The apparatus 10 has an exit cylinder 30 in fluid communication with the mixing chamber 26 at a second end. The exit cylinder 30 has an exit cylinder entrance face 28, exit channel 36, and an exit cylinder exit face 32. The exit cylinder entrance face 28 and exit face 32 are both substantially perpendicular to the flow of liquid passing through the apparatus 10. This is critical to achieve the desired suction and turbulence for efficient operation and saturation of the liquid with the gas.

As liquid passes through the liquid feed line 20 and into the stepped internal nozzle 22, the velocity of the fluid flowing there through is increased.

As the liquid leaves the stepped internal nozzle exit 34, a stream of splayed liquid 35 is created. The stream of splayed liquid passes through the mixing chamber 26 and into the exit cylinder channel 36. As the splayed liquid enters into the exit cylinder channel 36, the internal pressure of the mixing chamber 26, is reduced resulting in a vacuum. This in turn creates a vacuum on vent tube 24. The gas, generally ambient air, is pulled from the surface under the vacuum and into the mixing chamber 26. Where it is initially introduced to the liquid. The liquid/gas mixture is then sent into the exit cylinder 30 wherein it is further mixed to the point of saturation. The length of exit channel 36 is 1 to 10 times the exit cylinder diameter, dependent on the pressure of the motive flow, with a substantially perpendicular entrance face 28 and a substantially perpendicular exit face 30.

As the gas/liquid mixture passes through the exit cylinder channel 36, the mixture comes in contact with the walls of the exit cylinder channel 36, said walls are of uniform dimensions, said walls are neither converging nor diverging along the length of exit cylinder channel 36 and is subjected to cavitation. This contact occurring between the liquid/gas mixture and the walls of the exit cylinder channel 36 is important to the efficient operation of the apparatus 10. As the splayed liquid/gas mixture enters the exit cylinder channel 36, the mixture acts as a continuous flow piston, first, as in the down stroke/ intake stroke at the entrance to exit cylinder channel 36, then transitioning to a compression stroke before reaching the exit of the exit cylinder channel 36, which creates a continuous draw on the vent line as the liquid/gas mixture is then exited from the exit cylinder 30 into the surrounding body of liquid. Excess gas is released in the form of bubbles.

To provide a better understanding of a number of terms used in the specification and claims herein, the following definitions are provided.

The term cavitation, as used herein, is the creation and subsequent implosion of a gas bubble in a liquid low pressure.

The term gas, as used herein, is a form or state of matter in which a material assumes the shape of its container and expands to fill the container, thus having neither definite shape nor volume. Air is included in this definition.

The term liquid, as used herein, is a form of state of matter in which a material occupies a definite volume but has the ability to flow and assume the shape of its container.

The term pump, as used herein, is any apparatus that is capable of supplying a fluid under pressure.

The term saturation, as used herein, is the point at which a liquid contains the maximum quantity of a gas that is possible at a given temperature.

Following are examples illustrating procedures for practicing the invention. These examples should be construed to include obvious variations and not limiting.

EXAMPLE 1

In a preferred embodiment, the distance 44 from the exit of the reduction means 34 to the exit cylinder entrance face 28 is 1 to 10 times greater than the diameter of the exit cylinder 42 depending on the motive flow pressure. In addition, the length of the exit cylinder 30 is also dependent on the motive flow pressure and is 1 to 10 times greater than the diameter 42 of the exit cylinder 30. It is also desirable that the distance 50 from the inside of the exit channel 36 to the outer edge of the exit cylinder 30 be equal to or greater than the radius of the diameter 42 of the exit channel 36. It is also important to note that the entrance face 28 of the exit cylinder 30 as well as the exit face 32 of the exit cylinder 30 should be substantially perpendicular to the flow of the liquid stream.

EXAMPLE 2

With reference again to FIG. 1, in an alternative embodiment, the vent line 24 can be connected to an alternative gas source 25. Such an alternative gas source can include pressure pumps or other means whereby a gas is delivered under pressure or otherwise for introduction into the liquid. For example, when used in a pool or other body of water in which chlorination is desired, a chlorine gas supply can be connected in fluid communication with the vent line 24. In the alternative, the chlorine gas supply can be directly connected in fluid communication with the mixing chamber 26 at an alternate entrance. Either embodiment allows for the improved mixture of chlorine gas with water.

EXAMPLE 3

In a still further embodiment, the stepped internal nozzle 22 is not concentrically disposed in the mixing chamber 26. The stepped internal nozzle 22 may be disposed in any position in the mixing chamber 26 provided the liquid stream passing therefrom enters the exit channel 36 unobstructed.

EXAMPLE 4

In a still further embodiment, the air entering the vent line 24 may be filtered by a conventional filter prior to its introduction into the mixing chamber 26.

In yet another embodiment, the vent line 24 is connected to a secondary line in communication with the ambient liquid source. While this embodiment does not allow for a gas/liquid mixture, it does operate as a highly efficient vacuum for pools and the like. As such, a filter or other means to collect debris may be inserted in communication with the secondary line to allow for the collection and removal of such debris.

In as much as the preceding disclosure presents the best mode devised by the inventor for practicing the invention and is intended to enable one skilled in the pertinent art to carry it out, it is apparent that methods incorporating modifications and variations will be obvious to those skilled in the art. As such, it should not be construed to be limited thereby but should include such aforementioned obvious variations and be limited only by the spirit and scope of the following claims.

The invention claimed is:

1. An apparatus for introducing a gas into a liquid and/or degassing thereof, the apparatus comprising:

a liquid feed line in fluid communication with a liquid supply, wherein said liquid supply provides a pressurized liquid flow therethrough;

an internal nozzle having a stepped reduction therein, wherein a preselected number of steps in the reduction is dependent on a pressure of a motive flow, said internal nozzle attached to said liquid feed line, said internal nozzle having an exit diameter smaller than a diameter of said liquid feed lines, thus causing liquid flowing therethrough to increase velocity and induce hydro dynamics or hydraulic waves, and wherein limiting the length of said internal nozzle beyond the stepped reduction to 1 to 10 times the diameter, dependent on the pressure of the motive flow, creates a splayed stream;

a mixing chamber in fluid communication with a vent line, wherein said internal nozzle terminates at said mixing chamber;

an exit cylinder in fluid communication with said mixing chamber, said exit cylinder having an entrance face and an exit face, and a channel therebetween, wherein walls of said channel are neither converging nor diverging through which the liquid stream passes, said channel having a diameter 1 to 10 times greater than an exit to said internal nozzle, dependent on the pressure of the motive flow, and wherein an entrance face of said exit cylinder is substantially perpendicular to the flow of liquid from said internal nozzle.

2. The apparatus of claim 1 wherein said exit cylinder length is 1 to 10 times the diameter of the exit cylinder, dependent on the pressure of the motive flow, with a substantially perpendicular entrance face and substantially perpendicular exit face at each end of the exit cylinder.

3. The apparatus of claim 1 wherein said internal nozzle comprises from 1 to 20 steps substantially at right angles to the liquid flow for reduction, said number of steps dependent on the pressure of the motive flow.

4. The apparatus of claim 1 wherein the internal nozzle exit has a distance from said exit cylinder entrance 1 to 10 times the diameter to said exit cylinder, dependent on the pressure of the motive flow, with said distance from exit cylinder determined by the focal length of the splayed water flow exiting the stepped internal nozzle, dependent on the pressure of the motive flow.

5. The apparatus of claim 1 wherein the length of the internal nozzle is 1 to 10 times the diameter of the internal nozzle exit, dependent on the pressure of the motive flow.

6. The apparatus of claim 1 wherein the internal nozzle exit has a distance from said exit cylinder further determined by the focal length of the splayed water flow exiting the stepped internal nozzle, dependent on the pressure of the motive flow.

7. The apparatus of claim 1 wherein the exit face of said exit cylinder is substantially perpendicular to the flow of splayed liquid from said stepped internal nozzle.

8. The apparatus of claim 1 wherein said liquid supply comprises a pump.

9. The apparatus of claim 7 wherein said liquid supply is a pump selected from the group consisting of: bellow; centrifugal; diaphragm; drum; flexible liner; flexible impeller; gear hand; impeller; immersible; peristaltic piston; progressing cavity; and rotary submersible.

10. An apparatus useful for aeration and/or degassing of water, the apparatus comprising:

a liquid feed line in fluid communication with a liquid pump, wherein said liquid pump provides a pressurized liquid flow there through;

a stepped internal nozzle attached to said liquid feed line, wherein said stepped internal nozzle includes an exit diameter smaller than a diameter of said liquid feed line, thus causing liquid flowing therethrough to have an increase in velocity thereof and create a splayed stream, and wherein limiting a length of said stepped internal nozzle is dependent on pressure of a motive flow;

a mixing chamber in fluid communication with a vent line, wherein said internal nozzle terminates at said mixing chamber;

an exit cylinder in fluid communication with said mixing chamber, said exit cylinder having an entrance face and an exit face, and a channel through which the liquid stream passes, said channel having a uniform dimension neither converging nor diverging and having a diameter 1 to 10 times greater than the exit diameter to said stepped internal nozzle, dependent on the pressure of the motive flow, and wherein the entrance face of said exit cylinder is substantially perpendicular to the flow of liquid from said liquid feed.

11. The apparatus of claim 10, wherein, said liquid pump is selected from the group consisting of: bellow; centrifugal; diaphragm; drum; flexible liner; flexible impeller; gear hand; impeller; immersible; peristaltic piston; progressing cavity; and rotary submersible.

12. The apparatus of claim 10 wherein said stepped internal nozzle comprises a number of right angle steps of reduction, said number of steps of reduction dependent on the pressure of the motive flow.

13. A method of introducing a gas into a liquid comprising:

supplying a liquid from a liquid supply through a liquid feed line in fluid communication with said liquid supply, wherein said liquid supply provides a pressurized liquid flow therethrough;

passing said liquid flow through a stepped internal nozzle, said stepped internal nozzle attached to said liquid feed line, said stepped internal nozzle having an exit diameter smaller than a diameter of said liquid feed line, thus causing liquid flowing therethrough to have an increase in velocity thereof and create a splayed stream by limiting the length of said stepped internal nozzle, dependent on a motive flow pressure;

introducing said splayed stream into a mixing chamber in fluid communication with a vent line and wherein said splayed liquid stream initially mixes with a gas from said vent line for forming a splayed liquid/gas mixture;

introducing said liquid/gas mixture to an exit cylinder in fluid communication with said mixing chamber, having a substantially perpendicular entrance face and a substantially perpendicular exit face, and a channel of uniform dimensions neither converging nor diverging, through which the liquid stream passes and becomes subject to cavitation, said channel having a diameter 1 to 10 times greater than the exit to said stepped internal nozzle, dependent on the motive flow pressure, and wherein the entrance face of said exit cylinder is substantially perpendicular to the flow of splayed liquid from said stepped internal nozzle, wherein said splayed liquid/gas mixture is then exited from the apparatus into the surrounding body of liquid.

14. The method of claim 13 wherein said exit cylinder has a substantially perpendicular exit face of the apparatus.

15. The method of claim 13 wherein said internal nozzle comprises a number of stepped reductions, said number of steps dependent on the pressure of the motive flow.

16. The method of claim 13 wherein the internal nozzle exit has a distance from said exit cylinder 1 to 10 times greater than the diameter to said exit cylinder, dependent on the pressure of the motive flow.

17. The method of claim 13 wherein the internal nozzle exit has a distance from said exit cylinder ultimately deter mined by the focal length of the splayed liquid of which said focal length is dependent on the pressure of the motive flow.

18. The method of claim 13 wherein the exit face of said exit cylinder is substantially perpendicular to the flow of liquid from said internal nozzle.

19. The method of claim 13 wherein said liquid supply comprises a pump.

20. The method of claim 19 wherein said pump is selected from the group consisting of: bellow; centrifugal; diaphragm; drum; flexible liner; flexible impeller; gear hand; impeller; immersible; peristaltic piston; progressing cavity; and rotary submersible.

* * * * *